United States Patent [19]

Lindquist

[11] Patent Number: 4,635,834

[45] Date of Patent: Jan. 13, 1987

[54] APPARATUS FOR PATTERN CROCHETING

[76] Inventor: Kathy A. Lindquist, 2095 Avocado Ter., Hacienda Heights, Calif. 91745

[21] Appl. No.: 811,163

[22] Filed: Dec. 19, 1985

Related U.S. Application Data

[63] Continuation-in-part of Ser. No. 638,853, Aug. 8, 1984, abandoned.

[51] Int. Cl.[4] ..... D04B 3/06; B65H 49/36

[52] U.S. Cl. ..... 223/107; 66/1 A; 206/392; 242/137.1; 242/146

[58] Field of Search ..... 223/107; 66/1 A; 206/388, 392; 342/137.1, 146

[56] References Cited

U.S. PATENT DOCUMENTS

| | | | |
|---|---|---|---|
| 2,169,297 | 8/1939 | Smith | 223/107 |
| 2,264,664 | 12/1941 | Geisman | 242/137.1 |
| 2,493,208 | 1/1950 | Sedgewick | 66/1 A X |
| 2,628,042 | 2/1953 | Fitts et al. | 242/146 |
| 3,054,277 | 9/1962 | Broschard | 66/1 A |
| 3,517,828 | 6/1970 | Hunter | 206/392 X |
| 4,548,055 | 10/1985 | MacDonald | 66/1 A |

FOREIGN PATENT DOCUMENTS

| | | | |
|---|---|---|---|
| 8203890 | 5/1985 | Netherlands | 66/1 A |

*Primary Examiner*—Werner H. Schroeder
*Assistant Examiner*—J. L. Olds
*Attorney, Agent, or Firm*—Sellers and Brace

[57] ABSTRACT

Disclosed is a dispensing facility for differently colored skeins of yarn featuring a yarn tender operable to retain the yarn ends loosely captive and free of entanglement while being inverted as a group as a patterned crocheted workpiece is inverted at the end of each row of stitches. The yarn tender and the crocheted workpiece are both inverted in the same direction through one half a revolution preparatory to starting the next course of stitches. In one embodiment, the facility includes a compartmented storage receptacle for multiple skeins of colored yarns.

10 Claims, 4 Drawing Figures

10
11
12
14
15
16
18
19
20
21
23
25
26
28
29
30
33
34
36
36'
38

APPARATUS FOR PATTERN CROCHETING

This application is a continuation-in-part of my copending application for U.S. Letters Patent Ser. No. 06/638,853 filed Aug. 8, 1984 entitled Apparatus for Pattern Crocheting, now abandoned.

This invention relates to crocheting equipment and more particularly to a unique facility useful in crocheting patterned workpieces in different colored yarns utilizing a yarn tender invertible along with and in the same direction as the workpiece at the end of each row of stitches.

BACKGROUND OF THE INVENTION

It has long been common practice to knit various items of wearing apparel and the like in colored patterns. Typical equipment for use by knitters are disclosed in the following U.S. patents: Richard U.S. Pat. No. 611,333; Sedgwick U.S. Pat. No. 2,493,208; Fitts et al U.S. Pat. No. 2,628,042; and Broschard U.S. Pat. No. 3,054,277. These employ various expedients for avoiding entanglement of the different colors of yarn involved in knitting a variegated pattern. Sedgwick provides a one piece wire frame configured to support bobbins of the required number of colors. This device has numerous manifest disadvantages because limited to the use of bobbins and the ease with which it can be upset or moved from place to place unintentionally. Fitts et al proposes a yarn holder divided into a number of compartments and having a notched lid through which the strands are drawn. To change colors it is necessary to open the holder and physically transfer the skein from one compartment to another. Broschard provides a knitting accessory comprising a strip through which individual strands are passed from suspended bobbins. The individual strands are maintained in predetermined order by the notched strip and the weight of the various bobbins are suspended from the workpiece.

In items knitted or crocheted in patterns of different colors and having need for a repeated use of a particular color in the same row of stitches, the operator must endeavor to carry that color along the rear side of the item and to interlock it at intervals with stitches of a different color. This unavoidably renders the item unsightly. Moreover the back runs are easily ensnared on buttons, fasteners and by the user's fingernails.

SUMMARY OF THE INVENTION

This invention provides an improved yarn storage and yarn tender particularly useful in crocheting in any desired pattern using differently colored yarns without need for endeavoring to conceal a particular color yarn behind stitches in one or more other colors until that color is again needed in the same row of stitches.

The yarn storage and dispensing facility of this invention greatly expedites crocheting in a multiplicity of different colors. In one illustrative embodiment the required number of different colored skeins of yarn are stored in stackable compartmented trays any number of which interfit with one another to form a stack. The lowermost tray rests against a base member extending forwardly of the yarn dispensing ports in each tray. Pivotally supported on this extension is an elongated control member of a yarn tender, the control member being provided with a row of yarn control parts. As each course of stitches is completed the operator simply inverts the workpiece along with the yarn control member. Thus the yarn control member and the workpiece are rotated 180 degrees clockwise and counterclockwise through respective vertical arcsafter completing each row of stitches. So long as the particular color yarn is in use it remains threaded through the yarn control member and attached to the particular portion of the pattern utilizing that color. When no longer needed for that particular portion of the pattern that length of yarn is severed from the work piece but remains threaded through a hole of the yarn control member in readiness for pickup and reuse at a later time if there is need for that color. It will therefore be recognized that a very large number of differently colored yarns can be stored in the compartmented trays and prevented from becoming entangled because of the provision made for retaining each strand captive through a dispensing port in the storage trays and in the hole selected for it in the yarn control member. When there is no further need for a color, that strand can be severed with a sufficient length available for anchorage in that color portion of the workpiece.

In a second simplified embodiment, the yarn storage facility is deleted and the separate strands of multiple skeins of differently colored yarns are threaded through respective yarn feed ports of the yarn tender control member. The base of the yarn tender can be weighted and padded to restrain movement of the tender on a supporting surface. A strip of barbs along the face of the control member provides highly effective means for retaining the free ends of strands not in use captive and against unthreading from the control member.

Accordingly, it is a primary object of this invention to provide a unique yarn storage and yarn tending facility greatly expediting crocheting in variegated patterns and colors without risk of the multiple yarn strands becoming entangled.

Another object of the invention is the provision of the yarn storage and yarn tending facility utilizing stackable compartmented yarn trays provided along the yarn dispensing side thereof with a yarn control member pivotal through a 180 degree vertical arc along with the inversion of the workpiece in the same clockwise or counterclockwise direction.

Another object of the invention is to provide a yarn tender for use in crocheting multicolored patterns comprising a reversible yarn control member pivotal through 180 degrees between the yarn supply and the workpiece preparatory to crocheting the next course of stitches.

Another object of the invention is the provision of a simply constructed easily operated yarn tender for retaining a plurality of differently colored yarns releasably captive while in use to crochet colored workpieces and for simultaneously inverting all yarn ends as the workpiece is being inverted to crochet the next course of stitches.

Another object of the invention is the provision of equipment for simplifying and expediting the crocheting of work pieces in colored patterns with the opposite sides thereof equally neat and smooth.

These and other more specific objects will appear upon reading the following specification and claims and upon considering in connection therewith the attached drawing to which they relate.

Referring now to the drawing in which two preferred embodiments of the invention are illustrated:

Figures 1, 2:
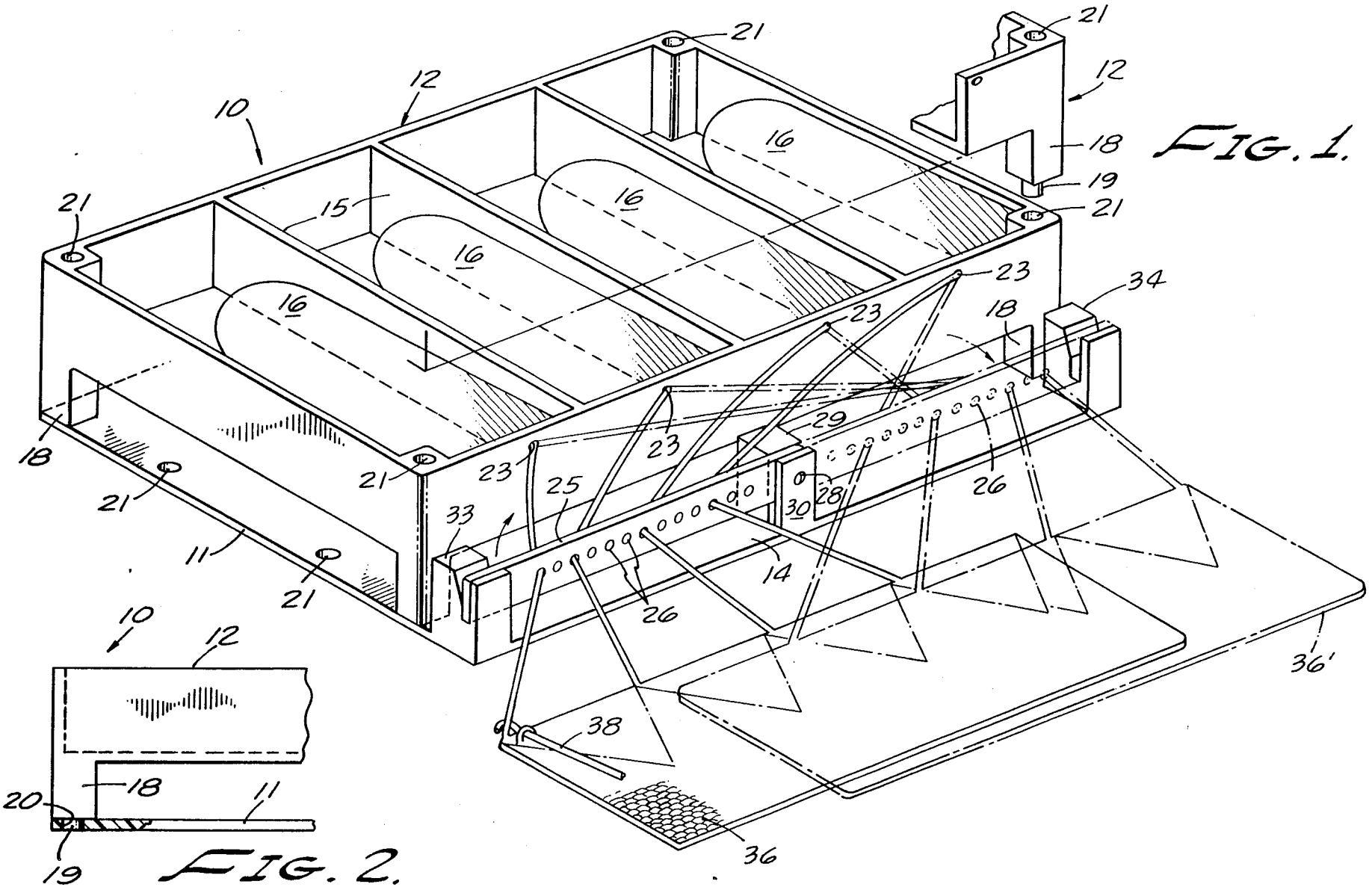
FIG. 1 is a perspective view embodying an illustrative mode of practising the invention and including a fragmentary showing of a stack of the storage trays.
FIG. 2 is a fragmentary view, partly in section, indicating the mode of assembly of the yarn tender beside the lowest storage tray.

Referring to FIGS. 1 and 2, there is shown a first illustrative embodiment of the invention crocheting accessory, designated generally 10, including a base member 11 and a plurality of identical yarn storage trays 12. The accessory is conveniently and inexpensively formed from molded thermoplastic. Base 11 underlies the stack of trays 12 and projects outwardly from one side thereof as indicated at 14 to provide a support for the yarn tender.

Trays 12 are divided by partitions 15 into compartments suitably sized to store a supply of differently colored yarns such as the skeins 16, 16. Preferably, but not necessarily, the trays include low height legs 18 each having a projection 19 at their lower ends insertable into the holes 20 of base 11 and serving to hold one or more trays assembled to the base. Each of the trays 12 is of identical design and construction as is indicated by the fragmentary showing of a second one of the trays in the upper right hand corner of FIG. 1. The upper corner of each tray is provided with a well 21 to seat the projection 19 at the lower end of each leg 18 of an overlying tray. The short legs 18 of the trays provide a low height gap between adjacent trays enabling the user to view the state of the yarn supply and to note that the yarn is being dispensed freely as needed and without becoming snarled with other portions of the supply. One sidewall of each tray is provided with at least one yarn outlet port 23 from each compartment. It has been found advantageous to locate ports 23 near the top rim of each compartment as this is advantageous in imposing a light drag on the yarn being dispensed from that port.

The yarn tender is mounted lengthwise of the base extension 14 underlying the yarn dispensing ports 23. As here shown, the yarn tender comprises an elongated rigid yarn control member 25 provided with a row of yarn control ports 26. One end of control member 25 is pivoted on the shank of a screw 28 supported in a pair of spaced apart bosses 29 and 30. The other or free end of control member 25 is frictionally receivable between the legs of a U-shaped boss 33 or 34 located at the respective opposite ends of base extension 14. As shown in full lines in FIG. 1, the control member 25 is seated between the legs of the U-shaped boss 33. However, after a course of crocheting stitches has been completed at the lefthand corner of the workpiece 36, control member 25 is pivoted clockwise through one half a revolution to the dot and dash line position shown in FIG. 1. Also the workpiece 36 is always inverted in the same direction as the control member before beginning the next row of stitches. This inverted position of the workpiece is indicated by the dot and dash rectangle in FIG. 1.

Figure 3:
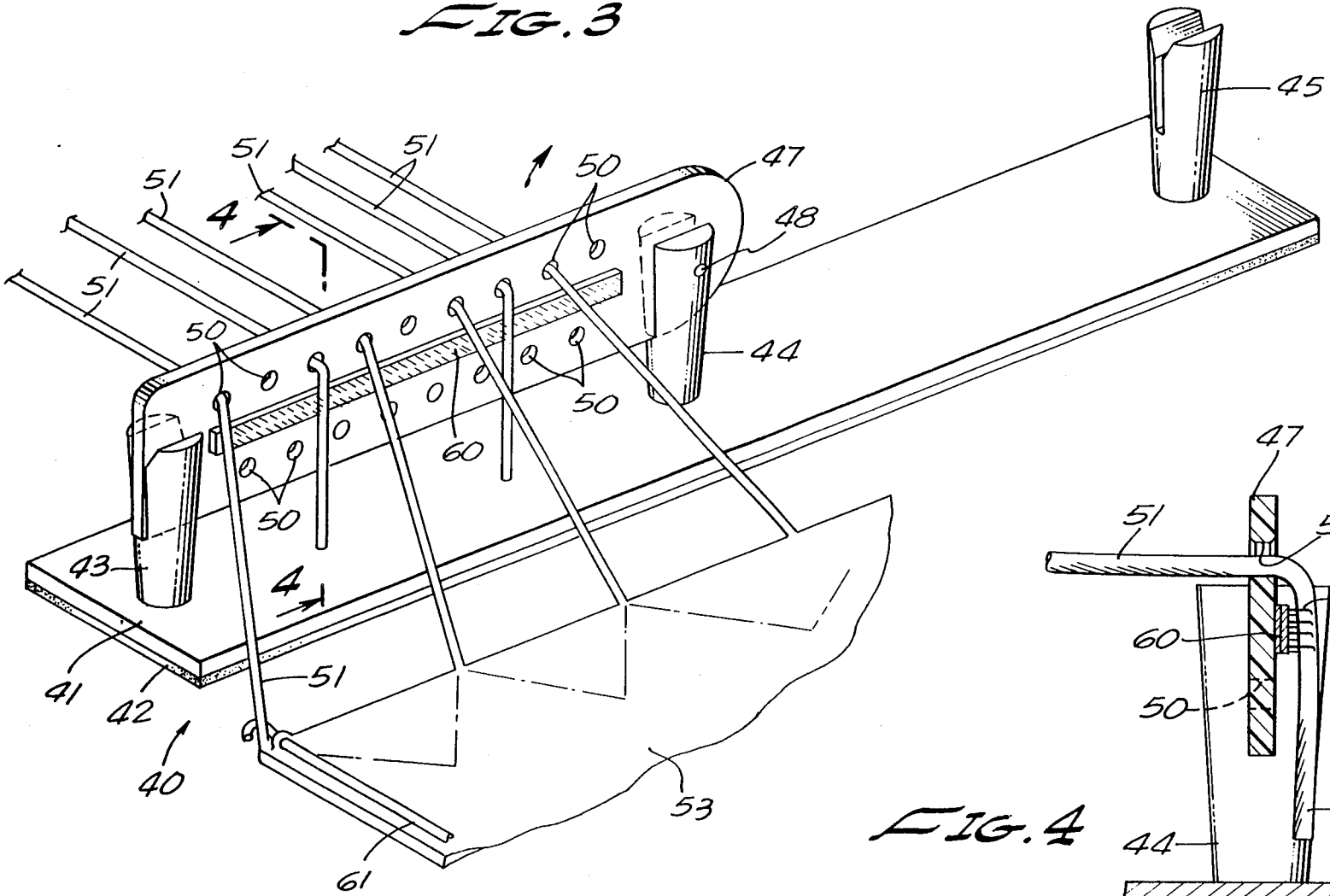
FIG. 3 is a perspective view of a second illustrative embodiment of the invention in use to crochet a workpiece incorporating a colored pattern.
Figure 4:
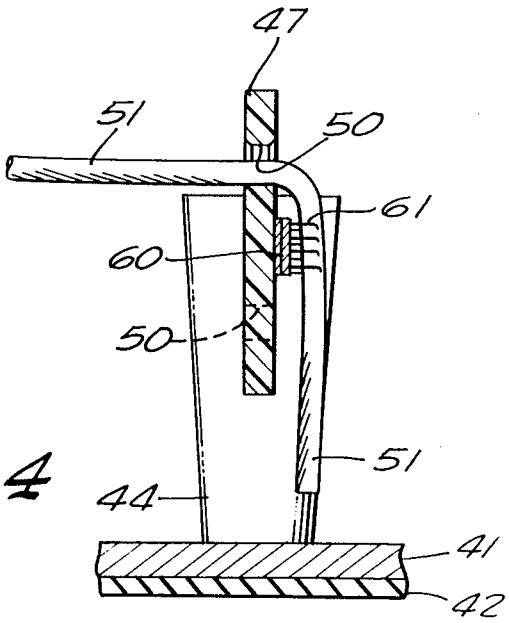
FIG. 4 is a cross section view on an enlarged scale along line 4—4 of the yarn control member showing the end of a yard strand not in use retained releasably captive on the retainer strip.

Referring now to FIGS. 3 and 4, there is shown a second illustrative embodiment of the invention designated generally 40 and comprising a yarn tender having an elongated base 41 preferably formed of heavy material such as metal bonded on its underside to a strip of soft material 42 such as sponge rubber. The weight of the base and its soft cover aids in holding the tender quite firmly anchored to a table top or the like working surface forwardly of rolls or of skeins of different color yarn not shown but similar to those described above in connection with the first embodiment. Upstanding from the opposite ends and the midlength of base 41 are a plurality of posts 43, 44, 45 having slotted upper ends having the same purpose as the similar slotted posts 29, 33 and 34 in FIG. 1. A yarn control member 47 is held pivotally assembled in the slot of post 44 by a pin 48. Member 47 pivots through 180 degrees from the position shown in full lines in FIG. 3 to its alternate position with its free end seated in the slot of post 45.

As herein showns control member 47 is provided with upper and lower rows of holes 50 each loosely accommodating a separate strand of colored yarn 51 from a separate skein of yarn not shown but rearwardly of tender 40. Strands 51 then in use are shown connected to that portion of a crocheting workpiece 53 at which that particular yarn color is being used in crocheting a course of stitching.

Normally in crocheting a workpiece, some yarn colors will not be in use and it is important that these be retained threaded through a desired hole 50 of the control member until there is need for that particular color. For this purpose the forward face of control member 47 has bonded thereto a strip 60 provided along its outer face with a multiplicity of flexible barbs 61 best shown in FIG. 4. A strip provided with such barbs is available commercially under the tradename of Velcro and this material serves admirably to retain captive the free end of the yarn strands not in use.

In use, the crocheter charges the compartments with supplies 16 of different colored yarns and threads the advance end of each through its dispensing port 23. Desirably, the supplies of different colors are arranged in the order in which they will be used in the pattern. If more than four colors are needed or if there is need for additional yarn of a particular color in any row of stitches, then additional trays are added to the lowest tray of yarns and the same procedure is followed in arranging the colors in the several compartments and threading the advance end of each through the dispensing ports 23. Before charging the second tray it is preferably assembled to the lower tray by inserting its projections 19 into the walls 21 of the underlying tray. After the required yarn supplies are assembled in the tray compartments the advance end of each supply is threaded through one of the row of holes 26 in control member 25. Usually this threading operation is carried out in the order in which the different colors are to appear in the workpiece. Most users find it expedites threading and crocheting to position trays 12 rearwardly of the yarn control member 25 which is accommodated by lifting the assembled stack of yarn trays from base member 11 and reseating the forward pair of projections 19 of the lower tray in a selected pair of wells 21 along the opposite lateral edges of the base member.

The second embodiment of the invention shown in FIGS. 3 and 4 is utilized in the same manner described above for the first embodiment. As shown in FIG. 3 the crocheter is completing the last stitch of a row of stitches proceeding from right to left. The crocheting hook 61 is in the process of completing the last stitch of that course. To begin the next row the operator inverts workpiece 53 along with control member 47 with the free end thereof seated in the slot of post 45. It will be noted that control member 47 is wider than the depth of the slots in the post with the result that the exposed upper corner of the control member is always accessible and serves as a thumb piece for use in withdrawing the member from the slot and moving it to its new alternate position.

With either embodiment, the crocheter starts a workpiece using the crocheting hook 38 and yarn of a suitable color for the pattern background. Usually a number of courses will be crocheted with this one color. Eventually the crocheter reaches the edge of the pattern to be represented in a selected different color. In one example of picking up a new color the user inserts the hook through the last loop of the base yarn and inserts the hook through the adjacent opening of the underlying course and picks up the yarn of the selected new color and proceeds to crochet with that color while taking the precaution to pull the last loop of the former color taut as crocheting continues with the new color. All strands of colored yarn are left attached to the portion of the pattern in which they are being used until that color area has been completed. At that time the crocheter severs the yarn leaving an adequate length attached to the crocheting to permit its anchorage by suitable techniques known to the crocheting art or the barbed yarn retainer feature of my second embodiment described below. The crocheter continues to crochet that row of stitches forming the type of stitch and substituting one color for another as required to produce the portion of the pattern located in that row of stitches.

FIG. 1 shows the crocheting needle 38 in the process of completing the last stitch at the lefthand corner of the workpiece. To start the next row of stitches, the user inverts the workpiece 36 clockwise one half a revolution to the position indicated in the dot and dash rectangle 36' and at the same time pivots control lever 25 of the yarn tender clockwise to its alternate operating position indicated by dot and dash lines in FIG. 1. The dispensed untensioned strands will now cross one another in the same direction while being used to crochet the next row of stitches from right to left. At the completion of the first section of the pattern the use of that color will be discontinued as the adjacent next color of the pattern is picked up and crocheted. When a new color of yarn is required other than those previously used, the user merely picks up the new color supplied from its storage compartment and threaded through an appropriate one of holes 26 in control member 25 of the yarn tender. An excess length of that color protruding from the workpiece is left attached until a sufficient portion of the new color of the pattern has been completed to permit anchorage and severance of an excess yarn.

As will be apparent from the foregoing, when the accessory is loaded and operated in the manner described a considerable number of different colors of untensioned yarn remain separated and non-crossing so long as the control member 25 is in one of its two positions whereas when it is in its alternate position the strands will cross one another only to be uncrossed when the yarn tender control lever is returned to its former position. Of importance too is the fact that the workpiece and the yarn control 25 are rotated alternately clockwise and counterclockwise before starting the next row of stitches.

The use of this invention does not impose any limitations on the variety and sequence of crocheting stitches well known to those skilled in the crocheting art. Crocheting a particular preselected pattern is preferably carried out following abbreviated instructions well known to the crocheting art including the type of stitch, the color yarn to use and the number of stitches to be taken in a particular color. Only four new shorthand instructions or symbols are found helpful. One of these is the symbol "SC1R", meaning "single crochet one loop of the color red". Actually a single crocheting stitch involves two parts or actions. The first part involves inserting the hook already supporting a loop and using the hook to pull in a second loop and designated by the symbol PUL meaning pull up. The second part of a single crocheting stitch involves pulling in a new loop through two loops then on the hook and which I designate by the symbol TOW. Another new symbol is a degree sign or symbol indicating the next color of yarn. This tells the crocheter that before crocheting this stitch she should pick up the color, red for example, and pull hard to conceal a short length of that color in the workpiece.

While the apparatus for pattern crocheting herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. An accessory to facilitate crocheting in colored patterns comprising:

a yarn tender for a plurality of differently colored supplies of yarn including control means for holding the leading end of each yarn supply loosely captive and untensioned; and one end of said control means for retaining the leading ends of said yarn strands from becoming entangled being pivotably mounted on said yarn tender and provided with a row of holes through which an individual yarn strand is threadable, said control means being manually invertible either backwardly or forwardly about an axis adjacent one end of said row of holes as each course of stitches is finished, and the crocheting workpiece being invertible in the same direction as said control means.

2. An accessory as defined in claim 1 characterized in that said control means comprises an elongated substantially rigid member having said row of holes distributed therealong; and means pivotably supporting one end of said rigid member for reversible movement in an upright plane through approximately one half of a revolution.

3. An accessory as defined in claim 2 characterized in that said rigid member is pivotable through a generally upright plane generally parallel to said one side of said yarn tender.

4. An accessory as defined in claim 1 characterized in that said accessory includes a plurality of similar stackable yarn storage trays each divided into separate yarn storage compartments with an associated feed port means in one side thereof for holding said leading yarn ends loosely captive; and said storage trays being provided with means for holding a plurality thereof internested in a vertical stack.

5. An accessory as defined in claim 4 characterized in that said trays are readily separable to provide access to yarn in an underlying tray.

6. An accessory as defined in claim 4 characterized in that said yarn control means is mounted on a support attachable to a first one of said yarn storage trays facing the yarn dispensing side thereof.

7. An accessory to facilitate crocheting in colored patterns comprising:

an elongated base having means on the underside thereof to resist movement of said base over a supporting surface;

elongated yarn control means overlying said base with one end thereof pivotally supported to the midlength of said base for intentional manual movement generally through a half circle as each course of crocheting stitches is finished;

said yarn control means having a plurality of openings distributed therealong each adapted to be occupied by the end of one of a plurality of differently colored yarns and selectively available for use by a person while crocheting in colored patterns.

8. An accessory as defined in claim 1 characterized in the provision of yarn keeper means on said yarn control means for releasably holding captive the leading end of yarn strand when not connected to a workpiece.

9. An accessory as defined in claim 8 characterized in that said yarn keeper means comprises a multiplicity of barbs extending along one lateral side of said yarn control means.

10. An accessory as defined in claim 7 characterized in the provision of means at the opposite ends of said base for retaining said yarn control means against unintended pivotal movement.

* * * * *